US012545491B1

(12) United States Patent
Way, Jr.

(10) Patent No.: US 12,545,491 B1
(45) Date of Patent: Feb. 10, 2026

(54) BEVERAGE CONTAINER INSULATOR

(71) Applicant: Robert W Way, Jr., Conroe, TX (US)

(72) Inventor: Robert W Way, Jr., Conroe, TX (US)

( * ) Notice: Subject to any disclaimer, the term of this patent is extended or adjusted under 35 U.S.C. 154(b) by 0 days.

(21) Appl. No.: 18/412,014

(22) Filed: Jan. 12, 2024

Related U.S. Application Data

(60) Provisional application No. 63/495,487, filed on Apr. 11, 2023.

(51) Int. Cl.

| | |
|---|---|
| ***A47G 23/02*** | (2006.01) |
| ***A45F 5/00*** | (2006.01) |
| ***B65D 65/00*** | (2006.01) |
| ***B65D 81/38*** | (2006.01) |

(52) U.S. Cl.
CPC ..... *B65D 81/3879* (2013.01); *A47G 23/02* (2013.01); *A47G 2023/0291* (2013.01); *B65D 2313/02* (2013.01)

(58) Field of Classification Search
CPC ..... A45C 2200/20; A45F 5/1583; A45F 5/00; A47G 23/02; A47G 23/0216; A47G 23/0266; A47G 23/0208; A47G 2023/0291; A47G 2023/0283; A47G 2023/0275; B65D 81/3879; B65D 81/3876; B65D 2313/02; B65D 81/3888; Y10S 150/901
USPC ..... 220/903, 737, 738, 739
See application file for complete search history.

(56) References Cited

U.S. PATENT DOCUMENTS

| | | | | | |
|---|---|---|---|---|---|
| D178,124 | S * | 6/1956 | Haslett | D7/625 | |
| 4,293,015 | A * | 10/1981 | McGough | B65D 81/3886 | 428/6 |
| 4,401,245 | A * | 8/1983 | Zills | B65D 81/3886 | 224/148.6 |
| D335,614 | S * | 5/1993 | Diab | D21/805 | |
| 5,320,249 | A * | 6/1994 | Strech | A47G 23/0216 | 220/771 |
| D360,806 | S * | 8/1995 | Morris | D7/608 | |
| 5,595,069 | A * | 1/1997 | Gies | B65D 81/3895 | 150/901 |
| 8,844,763 | B1 * | 9/2014 | Momirov | B65D 77/0406 | 206/524.1 |
| 10,183,799 | B1 * | 1/2019 | Luchak | B65D 81/3876 | |
| 2006/0150656 | A1 * | 7/2006 | Lu | F28D 20/00 | 62/304 |
| 2007/0175787 | A1 * | 8/2007 | Lown | A45F 3/16 | 206/427 |
| 2007/0181617 | A1 * | 8/2007 | Ramsey | B65D 81/3879 | 224/148.6 |
| 2014/0131372 | A1 * | 5/2014 | Hiner | B65D 81/3876 | 220/739 |

(Continued)

*Primary Examiner* — Gideon R Weinerth
(74) *Attorney, Agent, or Firm* — Richard Eldredge; Leavitt Eldredge Law Firm

(57) ABSTRACT

A beverage container insulator to be used in folded or unfolded configuration to insulate beverage containers of any size, comprising a blank body defining a hollow interior cavity for receiving a beverage container, comprising a front side, a back side, connected on the left side and right side with an open top, and a closed bottom, the front and back sides are terminally connected, via the bottom. A fastening patch is affixed to the front side of the body and a fastening strap is affixed to the back side and is capable of reaching the fastening patch by wrapping around to the front side of the body and tighten the gap and secure the beverage container in place.

3 Claims, 3 Drawing Sheets

(56) References Cited

U.S. PATENT DOCUMENTS

| | | | | |
|---|---|---|---|---|
| 2014/0339244 | A1* | 11/2014 | Arnold | A47G 23/0216 220/739 |
| 2015/0265083 | A1* | 9/2015 | Myers | B65D 25/54 220/737 |
| 2016/0046430 | A1* | 2/2016 | Tractenberg | A47G 23/0241 220/739 |
| 2016/0095457 | A1* | 4/2016 | Deakin | B65D 81/3876 29/428 |
| 2016/0316949 | A1* | 11/2016 | Kim | A47G 23/0216 |
| 2018/0257845 | A1* | 9/2018 | Phelps, III | C09J 4/06 |
| 2020/0115108 | A1* | 4/2020 | Ferrando García | B65D 85/72 |
| 2021/0052096 | A1* | 2/2021 | Leatherman | A47G 23/0216 |
| 2024/0002132 | A1* | 1/2024 | Domingos | B65D 81/3876 |
| 2024/0148173 | A1* | 5/2024 | Riemer | B65D 81/3886 |
| 2024/0253892 | A1* | 8/2024 | Doucette | B65D 43/0202 |

* cited by examiner

BEVERAGE CONTAINER INSULATOR

CROSS-REFERENCE TO RELATED APPLICATIONS

This application is a continuation of U.S. Provisional Application No. 63/495,487 filed on Apr. 11, 2023, which is hereby incorporated by reference in its entirety.

BACKGROUND

1. Field of the Invention

The present invention relates generally to beverage insulators, and more specifically to an adjustable beverage container insulator capable of fitting various types and sizes of beverage containers.

2. Description of Related Art

On a hot summer day, people adopt different methods to keep beverages cold. In general, insulators help insulate the beverage container and prevent condensation from forming on the outer surface. Condensation forms when humid, outside air comes into contact with the cold beverage container. The water droplets naturally heat up quickly, which in turn, warms up the beverage container. To keep beverages cold longer, it is important to choose an insulator that covers all outer surfaces of the beverage container.

A common problem faced by many consumers is finding the right size insulator to fit their beverage container. At concerts and sporting events especially, it is hard to predict how vendors will serve beverages. At some events, vendors might serve beer in 24 oz. cans, in which case the consumer must also purchase an insulator to fit that particular can. At the next event, vendors may decide to sell beverages in 32 oz. cups, which renders the earlier-bought insulator useless.

It is an objective of the present invention to provide a universal drink container insulator capable of fitting oversized cans and cups (24-32 oz.), as well as regular-size 12 oz. cans and bottles.

Accordingly, although great strides have been made in the area of beverage insulators, many shortcomings remain.

DESCRIPTION OF THE DRAWINGS

The novel features believed characteristic of the embodiments of the present application is outlined in the appended claims. However, the embodiments themselves, as well as a preferred mode of use, and further objectives and advantages thereof, will best be understood by reference to the following detailed description when read in conjunction with the accompanying drawings, wherein:

Figure 1:
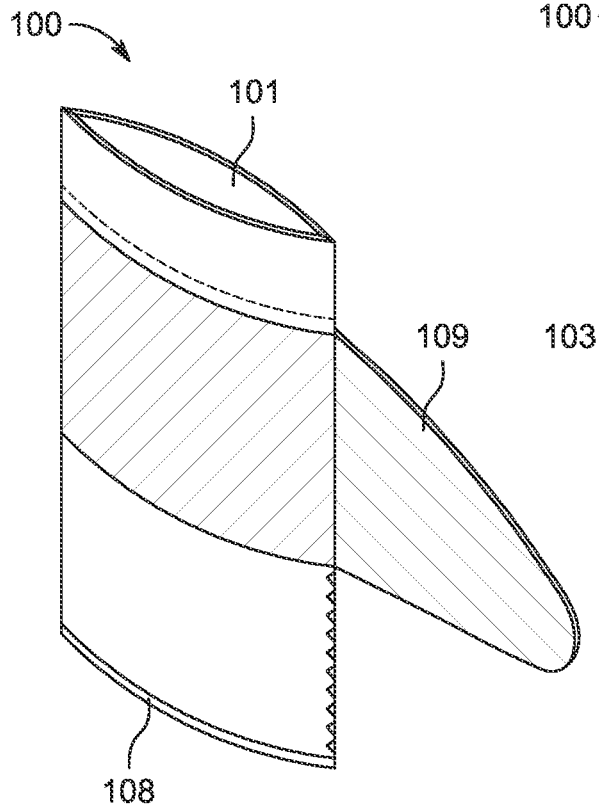
FIG. 1 is a front perspective view of a beverage container insulator according to the preferred embodiment of the present invention.

While the beverage container insulator and method of use of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed. Still, on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the beverage container insulator and the method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The beverage container insulator and method of use in accordance with the present application overcome one or more of the above-discussed problems commonly associated with conventional beverage insulators. Specifically, the present invention is a universal beverage container insulator to fit beverage containers of any size and made from neoprene material. It covers the sides and bottom of any style beverage container. These and other unique features of the beverage container insulator and method of use are discussed below and illustrated in the accompanying drawings.

The beverage container insulator and method of use will be understood, both as to its structure and operation, from the accompanying drawings, taken in conjunction with the accompanying description. Several embodiments of the beverage container insulator are presented herein. It should be understood that various components, parts, and features of the different embodiments may be combined and/or interchanged with one another, all of which are within the scope of the present application, even though not all variations and particular embodiments are shown in the drawings. It should also be understood that the mixing and matching of features, elements, and functions between various embodiments are expressly contemplated herein so that one of ordinary skill in the art would appreciate from this disclosure that the features, elements, and functions of one embodiment may be incorporated into another embodiment as appropriate unless described otherwise.

Neoprene described within the present invention embodies any kind of neoprene, including polychloroprene, a synthetic rubber product produced by the polymerization of chloroprene. Neoprene exhibits good chemical stability and maintains flexibility over a wide temperature range.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein reference characters identify corresponding or similar elements throughout the several views, FIGS. 1-7 depict different views of a beverage container insulator 100 in accordance with preferred embodiments of the present application. It will be appreciated that beverage container insulator 100 overcomes one or more of the above-listed problems commonly associated with conventional beverage insulators.

In the contemplated embodiment, the beverage container insulator 100 includes a blank body defining a hollow interior cavity 101 for receiving a beverage container 102 holding a liquid, comprising a front side 103, a backside 104, connected on left side 105 and right side 106 with an open top 107, and a closed bottom 108. The front and back sides are terminally connected, via the bottom.

In the contemplated embodiment, the beverage container insulator 100 can fit regular and oversized beverage containers. The left side 105 and right side 106 of the beverage container insulator 100 are fully stitched from top 107 to bottom 108.

In the contemplated embodiment, to tighten the gap and secure the beverage container in place, the beverage container insulator 100 further comprises a fastening mechanism 109 such as a fastening patch and a fastening strap or a Velcro patch and a Velcro strap. The Velcro patch is affixed to the front side 103. The Velcro strap is affixed to the backside 104 and is capable of reaching the Velcro patch by wrapping around to the front side 103. For use on normal-size containers (e.g., 12 oz cans), the beverage container insulator can be reduced in overall size. In particular, a stitching line runs laterally across the upper portion on both the front and back sides. The stitching line functions as a hinge point, allowing the user to easily fold the top lip down until reaching a lowered position.

In the contemplated embodiment, the beverage container insulator has a side opening that allows it to expand to fit large containers such as 32 oz. cups. An integrated Velcro strap can be opened and closed to stretch around oversized containers, thereby securing the container firmly in place. The beverage container insulator can also be reduced in size to fit normal 12 oz. cans and bottles simply by folding over the top lip. When not in use, the beverage container insulator can be flattened and stored in the user's pocket.

In the contemplated embodiment, the method of use of the beverage container insulator 100 includes opening the insulator sliding it over the beverage container fastening the Velcro strap tightly around the container, and using it in folded or unfolded configuration depending on the size of the container, the beverage container insulator fits over any beverage container, covering all sides and the bottom.

As illustrated in FIGS. 1-7, the beverage container insulator 100 can be configured in a folded or unfolded configuration, depending on the type and size of the container being used. An opening on the right side allows the beverage container insulator to expand to fit both regular and large-size containers. An integrated Velcro strap secures the container in place. For use on regular-size containers (e.g., 12 15 oz. bottles), the beverage container insulator 100 can be reduced in overall size by folding over the top lip. The reduced size makes it easier to handle when fitted onto smaller drinks such as 12 oz. cans or bottles.

In the contemplated embodiment, although the material of the present invention is preferably neoprene, it is understood that the material is not limited and can be manufactured in any suitable material based on design, user, and/or manufacturing requirements. As best seen in FIGS. 1-7, the main body is uniquely shaped to match the contours of any container. In particular, the main body comprises a front side, a back side, an open top, and a closed bottom.

Referring to FIGS. 1-7, the present invention is a universal beverage container insulator that can keep drinks cool regardless of the size of the container. When ready to use, the beverage container insulator fits over the user's drink, covering all sides and the bottom of the container. When ready to use, the bottom unfolds out to a flat, horizontal surface. The flat surface functions as a retainer, thereby keeping the container in place and preventing it from sliding out.

Figure 2:
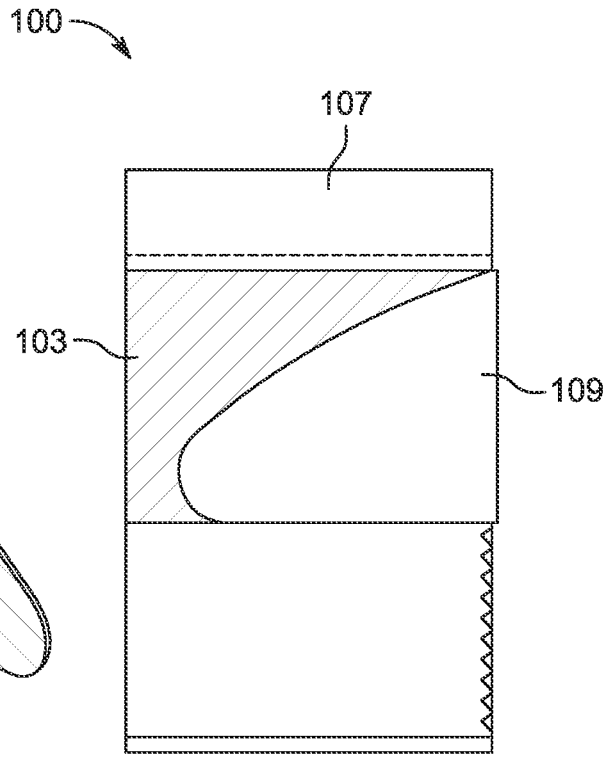
FIG. 2 is a front elevational view of the present invention, shown in a closed position.
Figure 3:
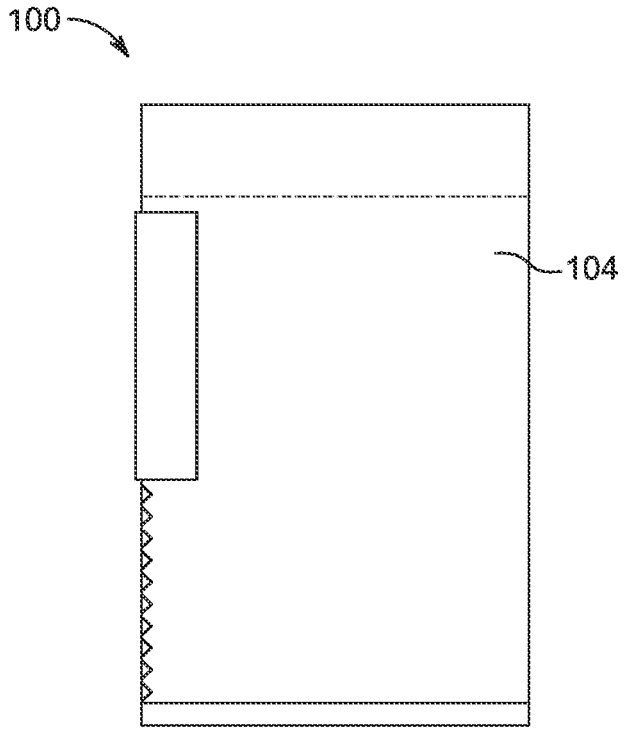
FIG. 3 is an enlarged rear elevational view of the present invention.
Figure 4:
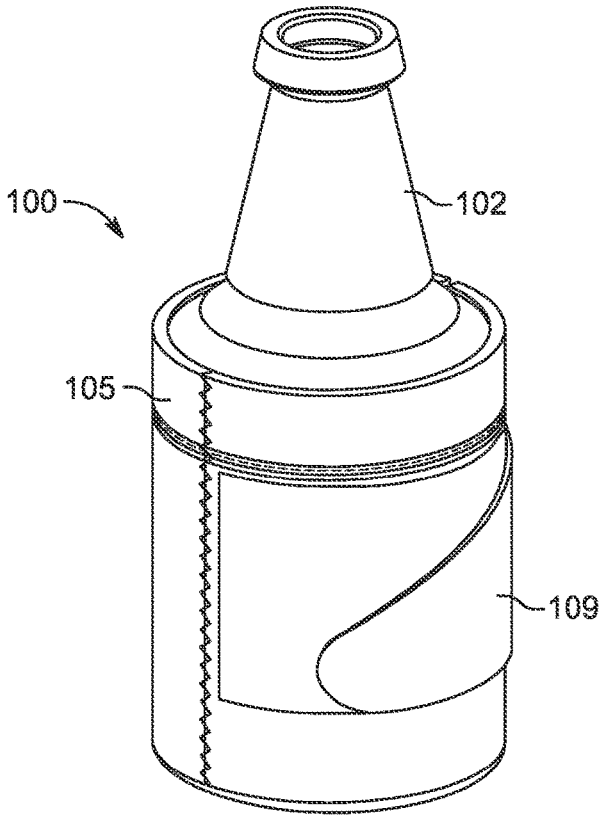
FIG. 4 is a front, left-side perspective view of the present invention, shown attached to a bottle in a closed, unfolded position.
Figure 5:
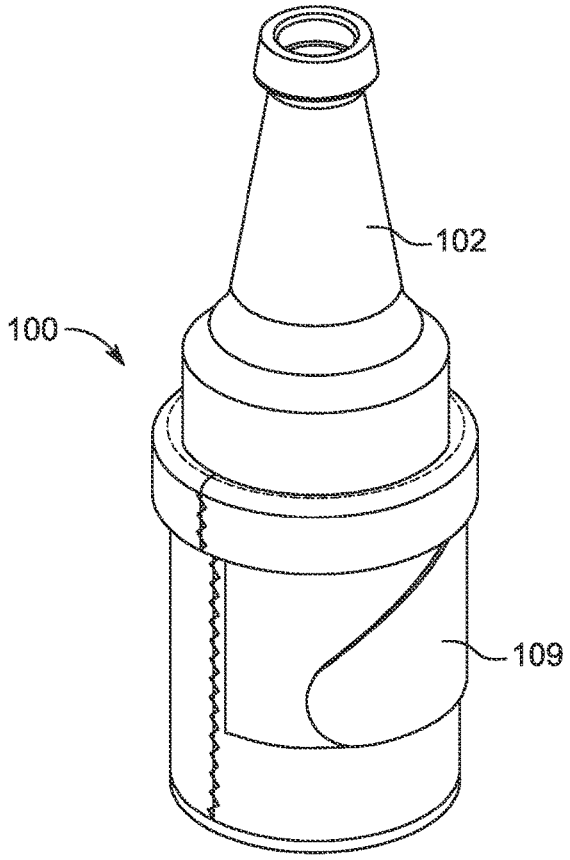
FIG. 5 is a front, left-side perspective view of the present invention, shown attached to a bottle in a closed, folded position.
Figure 6:
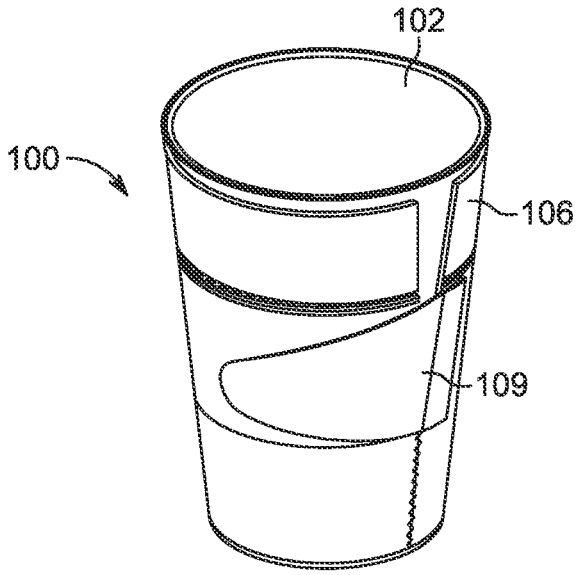
FIG. 6 is a front, right-side perspective view of the present invention, shown attached to a cup in a closed, unfolded position.
Figure 7:
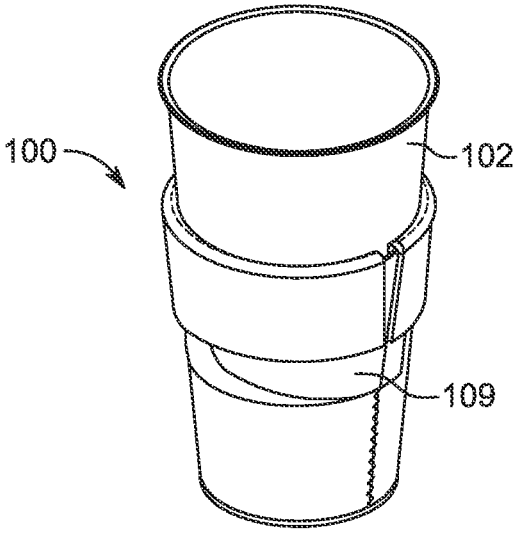
FIG. 7 is a front, right-side perspective view of the present invention, shown attached to a cup in a closed, folded position.

In the contemplated embodiment, to fit any size container, the front and back sides are uniquely stitched together. In particular, the left side is fully stitched from top to bottom. The right side is partially stitched, from the bottom up to a predetermined height. As best seen in FIGS. 6-7, the right-side opening created by the partial stitching allows the beverage container insulator to expand to fit large drinks having non-linear sides (e.g., 24 oz. cups). To secure the user's drink in place, the Velcro strap (hook side) removably attaches to the Velcro patch (loop side). As best seen in FIGS. 1-3, the Velcro patch is sewn on the front side. In particular, the Velcro patch extends laterally from the left side to the right side, directly above the partial stitching on the right side. Longitudinally, the Velcro patch extends up to a predetermined height.

As seen in FIG. 3, a portion of the Velcro strap is sewn on the back side, adjacent to the right-side edge. The Velcro strap is aligned with the Velcro patch on the opposite side. Thus, the Velcro strap is capable of reaching the Velcro patch by wrapping around the front side. In effect, the Velcro strap helps tighten the right-side gap opening, thereby securing the container in place. It is understood that the means of attachment is not limited to Velcro and can be of any type of hook and loop fastener.

In the contemplated embodiment, to fit normal-size containers such as 12 oz. cans and bottles, the present invention further comprises a lateral stitching line above the Velcro patch. As best seen in FIGS. 6-7, the stitching line extends laterally from left to right, on both the front and back sides. The stitching line functions as a hinge point, allowing the user to easily roll the top lip downward until reaching the folded position (see FIGS. 5 and 7). In the folded position, the beverage container insulator is reduced in size, making it easier to handle smaller containers. For large containers that require more insulation, the user has the option to keep the top lip in the unfolded position (see FIGS. 4 and 6). Although the invention has been explained in relation to its preferred embodiment, it is to be understood that many other possible modifications and variations can be made without departing from the spirit and scope of the invention.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A beverage container insulator comprising:

a blank body defining a hollow interior cavity for receiving a beverage container, comprising a front side, a back side, a left side and right side with an open top, and a closed bottom; wherein the front and back sides are terminally connected, via the bottom;

a fastening patch affixed to the front side of the body;

a fastening strap affixed to the back side and is capable of reaching the fastening patch by wrapping around to the front side of the body to tighten and secure the beverage container in place;

wherein the left side of the beverage container insulator is fully stitched from top to bottom and the right side is partially stitched, from the bottom up to a predetermined height below the top to define a gap;

wherein a stitching line runs laterally across an upper portion on both the front and back sides and functions as a hinge point, allowing a user to easily fold a top lip down;

wherein the beverage container insulator can be used in either a folded or unfolded configuration to insulate beverage containers of varying sizes.

2. The beverage container insulator of claim 1, wherein the beverage container insulator is made of neoprene or any other suitable insulating material.

3. The beverage container insulator of claim 1, wherein the beverage container insulator is configured to be flattened and stored when not in use.

* * * * *